US010480463B2

(12) United States Patent
Yoshizumi et al.

(10) Patent No.: US 10,480,463 B2
(45) Date of Patent: Nov. 19, 2019

(54) ENGINE

(71) Applicant: MITSUBISHI HEAVY INDUSTRIES ENGINE & TURBOCHARGER, LTD., Sagamihara-shi, Kanagawa (JP)

(72) Inventors: Hiroshi Yoshizumi, Tokyo (JP); Hideaki Okumura, Tokyo (JP); Shoji Namekawa, Tokyo (JP)

(73) Assignee: MITSUBISHI HEAVY INDUSTRIES ENGINE & TURBOCHARGER, LTD., Sagamihara-Shi (JP)

( * ) Notice: Subject to any disclaimer, the term of this patent is extended or adjusted under 35 U.S.C. 154(b) by 0 days.

(21) Appl. No.: 15/747,637

(22) PCT Filed: Aug. 4, 2016

(86) PCT No.: PCT/JP2016/072933
§ 371 (c)(1),
(2) Date: Jan. 25, 2018

(87) PCT Pub. No.: WO2017/022823
PCT Pub. Date: Feb. 9, 2017

(65) Prior Publication Data

US 2018/0216585 A1 Aug. 2, 2018

(30) Foreign Application Priority Data

Aug. 6, 2015 (JP) ..... 2015-155788

(51) Int. Cl.
*F02M 35/10* (2006.01)
*F02M 35/116* (2006.01)
(Continued)

(52) U.S. Cl.
CPC ..... *F02M 35/10045* (2013.01); *F02B 75/22* (2013.01); *F02M 35/104* (2013.01);
(Continued)

(58) Field of Classification Search
CPC ..... F02M 35/10045; F02M 35/10052; F02M 35/116; F02B 75/22
See application file for complete search history.

(56) References Cited

U.S. PATENT DOCUMENTS 4,425,881 A 1/1984 Lyndhurst
5,027,753 A * 7/1991 Hamazaki ..... F02B 27/02 123/184.31
(Continued)

FOREIGN PATENT DOCUMENTS

DE 44 33 285 A1 3/1996
EP 2 683 925 A1 1/2014
(Continued)

OTHER PUBLICATIONS

International Search Report dated Oct. 11, 2016 in Application No. PCT/JP2016/072933 with an English Translation.
(Continued)

*Primary Examiner* — Jacob M Amick
(74) *Attorney, Agent, or Firm* — Birch, Stewart, Kolasch & Birch, LLP

(57) ABSTRACT

An engine includes a plurality of cylinders, a gas chamber, and a heat shielding member. The plurality of cylinders are provided along a crankshaft. The gas chamber extends from a first end portion toward a second end portion in a direction of an axial line of the crankshaft and distributes gas into the plurality of cylinders. The heat shielding member is provided in the gas chamber. The heat shielding member extends from the first end portion toward the second end portion and shields heat radiated from an inner wall surface of the gas chamber.

5 Claims, 10 Drawing Sheets

(51) Int. Cl.

| | |
|---|---|
| ***F02M 35/104*** | (2006.01) |
| ***F02B 75/22*** | (2006.01) |
| *F02B 29/04* | (2006.01) |
| *F02B 77/11* | (2006.01) |

(52) U.S. Cl.
CPC .... *F02M 35/10052* (2013.01); *F02M 35/116* (2013.01); *F02B 29/04* (2013.01); *F02B 29/0443* (2013.01); *F02B 77/11* (2013.01)

(56) References Cited

U.S. PATENT DOCUMENTS

| | | | | |
|---|---|---|---|---|
| 6,032,634 | A * | 3/2000 | Minegishi ..... | F02B 27/02 123/184.55 |
| 2011/0232598 | A1 | 9/2011 | Harada et al. | |

FOREIGN PATENT DOCUMENTS

| | | | |
|---|---|---|---|
| JP | 2-286822 | A | 11/1990 |
| JP | 6-249091 | A | 9/1994 |
| JP | 2003-262131 | A | 9/2003 |
| JP | 2010-270735 | A | 12/2010 |
| JP | 2011-185147 | A | 9/2011 |
| JP | 2012-87773 | A | 5/2012 |
| WO | WO 2012/123629 | A1 | 9/2012 |

OTHER PUBLICATIONS

Written Opinion dated Oct. 11, 2016 in Application No. PCT/JP2016/072933 with an English Translation.

* cited by examiner

ENGINE

TECHNICAL FIELD

The present invention relates to an engine.

Priority is claimed on Japanese Patent Application No. 2015-155788, filed Aug. 6, 2015, the content of which is incorporated herein by reference.

BACKGROUND ART

In a multi-cylinder engine having a plurality of cylinders, air is introduced from the outside via an air cleaner box or the like. The air introduced through the air cleaner box or the like, or a mixture of fuel and air (hereinafter, simply referred to as a gas) is distributed to each of the cylinders via an intake passage. The filling amount of the gas in each of the cylinders changes according to a temperature of the gas. That is, the air-fuel ratio changes depending on the temperature of the gas. Therefore, there is a possibility that combustion in the cylinder may be adversely affected by such a change in the air-fuel ratio.

Patent Document 1 describes a V-type multi-cylinder engine in which supplied air compressed by a supercharger is cooled by an intercooler and then filled into each of cylinders. In the case of the multi-cylinder engine disclosed in Patent Document 1, the temperature of the supplied air is detected, and the amount of coolant flowing into the intercooler is increased or decreased according to the detected temperature of the supplied air. In Patent Document 1, the temperature of the air is kept constant by increasing or decreasing the amount of the coolant as described above, and thus the change in the air-fuel ratio is suppressed.

CITATION LIST

Patent Literature

[Patent Document 1]

Japanese Unexamined Patent Application, First Publication No. 2003-262131

SUMMARY OF INVENTION

Technical Problem

In addition to the supercharged multi-cylinder engine described in Patent Document 1, in all multi-cylinder engines including a naturally aspirated multi-cylinder engine, as the number of cylinders increases, a length of a passage guiding the gas to the cylinder tends to become longer. When the passage becomes long as described above, it is assumed that the gas flowing in the passage is heated by radiation heat from a cylinder block or the like. That is, there is a possibility of a cylinder farther from the air cleaner box or the like being filled with a high temperature gas. Therefore, there is a possibility of the air-fuel ratio of each of the cylinders varying and adversely affecting combustion.

It is an object of the present invention to provide an engine capable of stabilizing combustion in all cylinders and improving efficiency.

Solution to Problem

According to a first aspect of the present invention, an engine includes a plurality of cylinders, a gas chamber, and a heat shielding member. The plurality of cylinders are provided along a crankshaft. The gas chamber extends from a first end portion toward a second end portion in a direction of an axial line of the crankshaft and distributes gas into the plurality of cylinders. The heat shielding member is provided in the gas chamber, extends from the first end portion toward the second end portion and shields heat radiated from an inner wall surface of the gas chamber.

Due to such a constitution, it is possible to prevent the gas flowing in the gas chamber on a side opposite to the inner wall surface with the heat shielding member interposed therebetween from being heated by radiation heat from the inner wall surface of the gas chamber. That is, it is possible to limit an increase in temperature while the gas flows from the first end portion toward the second end portion, and thus it is possible to reduce the temperature difference between the temperature of the gas close to the first end portion of the gas chamber and the temperature of the gas close to the second end portion. As a result, it is possible to stabilize combustion in all of the cylinders by suppressing variation of an air-fuel ratio in each of the cylinders. Furthermore, by stabilizing the combustion, the occurrence of knocking is suppressed, and thus an ignition timing can be set to an advance side, and the efficiency can be improved.

According to a second aspect of the present invention, the engine according to the first aspect may include a cooling device configured to cause a coolant cooling the cylinders to flow from the first end portion toward the second end portion in the direction of the axial line. The heat shielding member may partition an internal space of the gas chamber into a first space and a second space. The first space guides the gas introduced into the gas chamber from the first end portion toward the second end portion. The second space communicates with the first space and distributes the gas flowing in from the first space into the plurality of cylinders while guiding the gas from the second end portion toward the first end portion.

Since the gas chamber is partitioned into the first space and the second space by the heat shielding member, the influence of the radiation heat on the gas flowing in the first space can be reduced. Therefore, it is possible to guide the gas from the first end portion to the second end portion while suppressing the increase in the temperature of the gas flowing in the first space. The gas guided to the second end portion flows into the second space on a side close to the second end portion, flows toward the first end portion and flows into each of the cylinders along the way. The temperature of the coolant is gradually increased from the first end portion toward the second end portion. However, since the gas flowing in the second space can flow from a side close to the second end portion in which the temperature of the coolant is high to a side close to the first end portion in which the temperature of the coolant is low, an increase in the temperature of the gas flowing from the second end portion to the first end portion in the second space can be limited. As a result, it is possible to stabilize the combustion in all of the cylinders by limiting the variation of the air-fuel ratio in each of the cylinders. Further, by stabilizing the combustion, the occurrence of knocking is suppressed, and thus the ignition timing can be set to the advance side, and the efficiency can be improved.

According to a third aspect of the present invention, the heat shielding member of the engine of the second aspect may extend in the direction of the axial line so that the second space is disposed between an inner wall surface of the gas chamber adjacent to the cylinder and the first space.

Due to such a constitution, it is possible to limit an increase in the temperature of the gas due to the radiation heat resulting from heat generation of the cylinder while the gas flows from the side close to the first end portion to the side close to the second end portion in the first space.

According to a fourth aspect of the present invention, the heat shielding member of the engine of the second or third aspect may be formed in a cylindrical shape extending in the direction of the axial line.

Due to such a constitution, the increase in the temperature of the gas flowing in the first space due to the radiation heat from the inner wall surface of the gas chamber can be further suppressed.

According to a fifth aspect of the present invention, in the engine according to any one of the first to fourth aspects, the plurality of cylinders may be arranged in a V shape, and the gas chamber may be arranged between banks of the cylinders arranged in the V shape.

In the case in which the gas chamber is provided between the banks of a so-called V-type engine, the heat of the cylinder of each bank is transmitted to the inner wall surface of the gas chamber. However, since the heat shielding member is provided in the gas chamber, it is possible to suppress the increase in the temperature as the gas flowing from the side close to the first end portion to the side close to the second end portion in the first space approaches the second end portion.

According to a sixth aspect of the present invention, the engine according to any one of the first to fifth aspects may include a supercharger, a gas cooler, and a guide surface. The supercharger compresses the gas introduced from the outside. The gas cooler cools the gas compressed by the supercharger before being introduced into the gas chamber, and the guide surface is provided in the gas chamber and guides condensed water contained in the gas introduced into the gas chamber.

Due to such a constitution, even in the case in which the condensed water generated when the gas compressed by the supercharger is cooled by the gas cooler intrudes into the gas chamber, the condensed water can flow along the guide surface of the gas chamber. Therefore, it is possible to smoothly discharge the condensed water from a desired position.

Advantageous Effects of Invention

According to the engine, it is possible to stabilize the combustion in all the cylinders and to improve the efficiency.

DESCRIPTION OF EMBODIMENTS

First Embodiment

Hereinafter, an engine according to a first embodiment of the present invention will be described with reference to the drawings.

Figure 1:
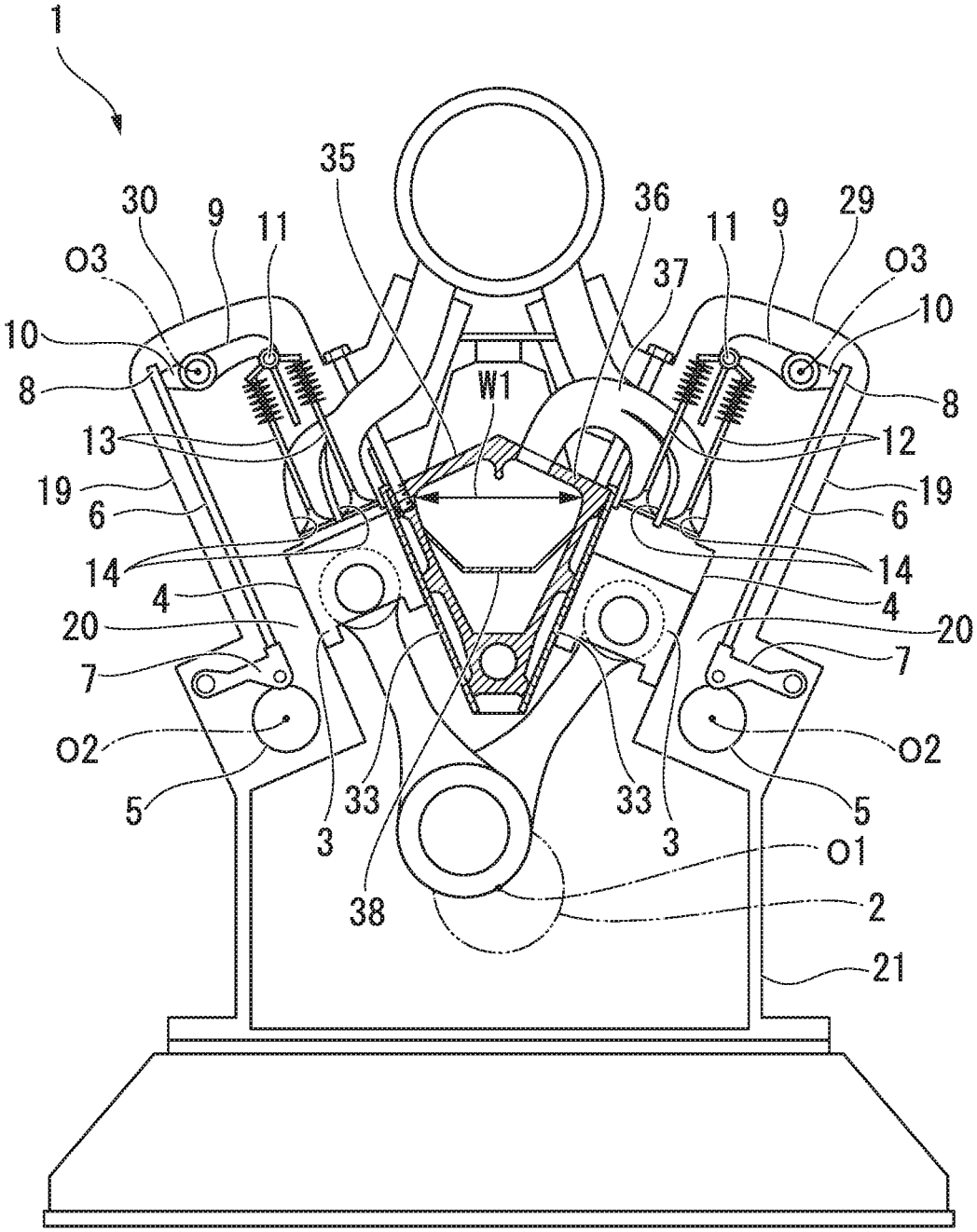
FIG. 1 is a view showing a schematic constitution of an engine in a first embodiment of the present invention.

FIG. 1 is a view showing a schematic constitution of an engine in the first embodiment of the present invention.

An engine 1 in the embodiment is a stationary engine forming a power generation system and is a multi-cylinder gas engine which is longer in a direction of an axial line of a crankshaft 2 than in a width direction. The engine 1 is driven using, for example, natural gas or the like as a fuel.

As shown FIG. 1, the engine 1 in the embodiment is a so-called V-type engine in which cylinders 4 accommodating adjacent pistons 3 are arranged in a V shape at a predetermined bank angle in the direction of the axial line of the crankshaft 2. The engine 1 in one example of the embodiment has a layout of a so-called overhead valve (OHV). The layout of the engine 1 may be a layout other than that of the OHV.

The engine 1 has a cam shaft 5 on an outside of the cylinder 4 in a width direction orthogonal to the crankshaft 2. The cam shaft 5 extends in the direction of the axial line O1 of the crankshaft 2. When the cam shaft 5 is rotated, a cam of the cam shaft 5 displaces a base end portion 7 of a push rod 6 upward and downward. A base portion 10 of a rocker arm 9 is linked to a distal end portion 8 of the push rod 6. The rocker arm 9 is formed to be rockable around a rocking axis O3 in parallel with an axis O2 of the cam shaft 5. Further, an end portion 11 of the rocker arm 9 is formed to be capable of pressing an intake valve 12 and an exhaust valve 13. The intake valve 12 and the exhaust valve 13 are formed to be biased in a direction in which a port 14 of the cylinder 4 closes, and to open the port 14 of the cylinder 4 only when pressed by the rocker arm 9.

The engine 1 in the embodiment is an auxiliary chamber type gas engine having an auxiliary chamber (not shown) in a cylinder cover 19. In this auxiliary chamber, fuel is supplied to an internal space thereof via an auxiliary chamber gas supply passage (not shown). The fuel supplied into the auxiliary chamber is ignited by a spark plug or the like. A flame resulting from the ignition flows into a main chamber of the cylinder 4 from the auxiliary chamber.

Figure 2:
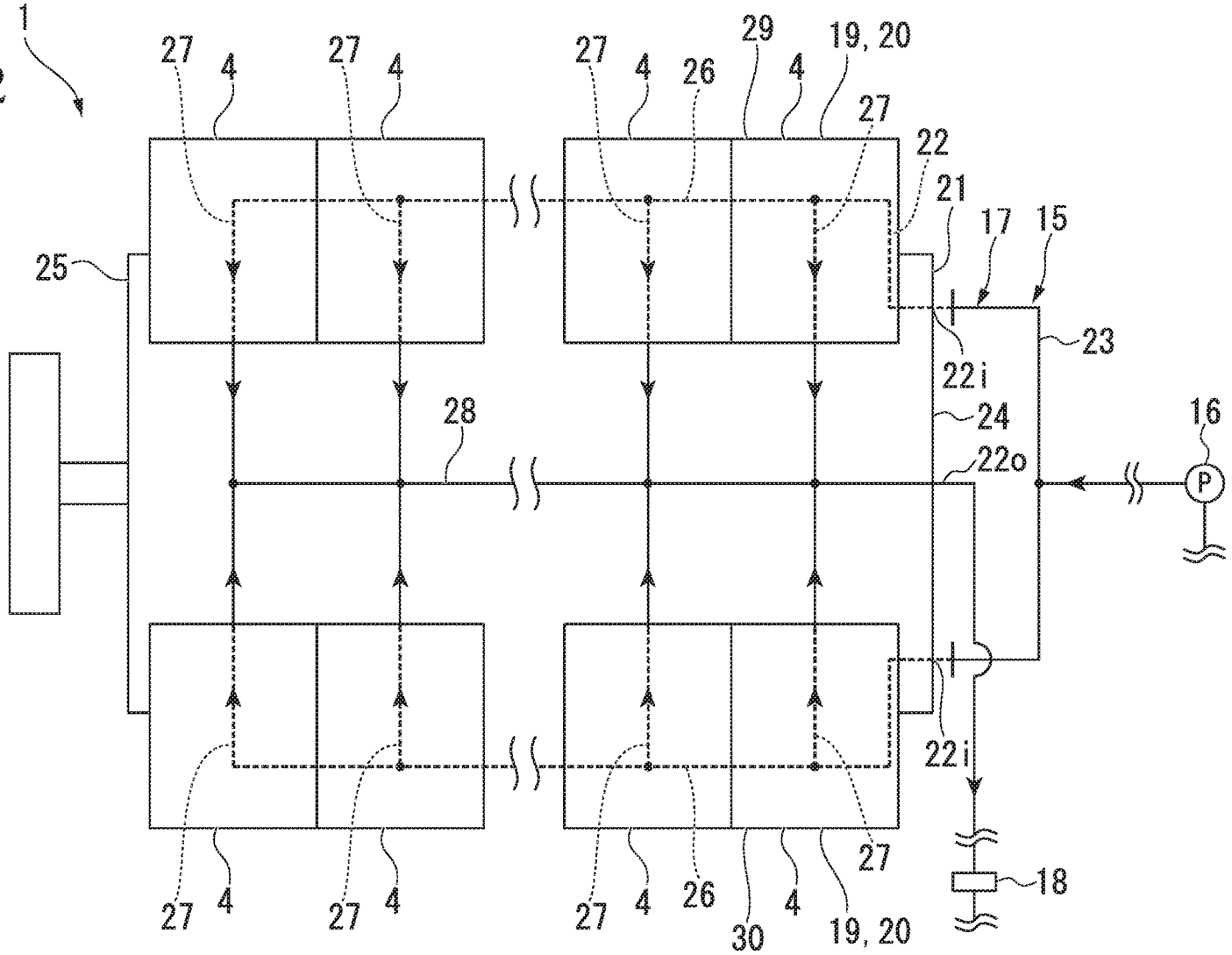
FIG. 2 is a view showing a schematic constitution of a cooling device of the engine according to the present invention.

FIG. 2 is a view showing a schematic constitution of a cooling device of the engine according to the present invention.

As shown in FIG. 2, the engine 1 has a cooling device 15 which cools the cylinder cover 19, a cylinder block 20 and so on. The cooling device 15 mainly includes a coolant pump 16, a coolant passage 17, and a radiator 18.

The coolant pump 16 applies a pressure to a coolant so that the coolant circulates through an internal flow path of the coolant passage 17.

The coolant passage 17 is formed in the cylinder cover 19, the cylinder block 20, a crankcase 21, and so on. The coolant passage 17 in the embodiment has an internal passage 22 and an external passage 23. The internal passage 22 is formed inside the cylinder cover 19, the cylinder block 20, the crankcase 21, and so on. The internal passage 22 has two inlet ports 22*i* connected to the external passage 23 and one outlet port 22*o* at a first end portion 24 in the direction of the axial line O1 (refer to FIG. 1) of the crankshaft 2. Here, a gear box, a flow path for lubricating oil, and so on are usually disposed at a second end portion 25 opposite to the first end portion 24 in the direction of the axial line O1 of the crankshaft 2. Therefore, the inlet ports 22*i* and the outlet port 22*o* of the coolant passage 17 are formed only in the first end portion 24.

The internal passage 22 includes supply passages 26, branch passages 27, and a return passage 28.

The supply passages 26 communicate with the inlet ports 22*i* and extend along each of a first bank 29 and a second bank 30 arranged in a V shape. The supply passages 26 are formed in the cylinder block 20 of the first bank 29 and the cylinder block 20 of the second bank 30. The supply passages 26 guide the coolant from the first end portion 24 toward the second end portion 25 in each of the first bank 29 and the second bank 30 in the direction of the axial O1.

Among of the branch passages 27, the branch passage 27 formed in the first bank 29 branches off from the supply passage 26 formed in the first bank 29 and supplies the coolant to each of the cylinders 4 of the first bank 29. The branch passage 27 of the first bank 29 passes through an outer circumference of a liner 33 (refer to FIG. 1) of the cylinder 4 of the first bank 29 formed in a cylindrical shape and passes through an inside of the cylinder cover 19 of the first bank 29. In the embodiment, the coolant flowing through the branch passage 27 of the first bank 29 flows, in turn, through the outer circumference of the liner 33 of the cylinder 4 of the first bank 29 and the inside of the cylinder cover 19 of the first bank 29 and flows into the return passage 28.

Likewise, the branch passage 27 formed in the second bank 30 branches off from the supply passage 26 formed in the second bank 30 and supplies the coolant to each of the cylinders 4 of the second bank 30. The branch passage 27 of the second bank 30 passes through an outer circumference of the liner 33 (refer to FIG. 1) of the cylinder 4 of the second bank 30 formed in a cylindrical shape and passes through an inside of the cylinder cover 19 of the second bank 30. In the embodiment, like the coolant flowing through the branch passage 27 of the second bank 30, the coolant flowing through the branch passage 27 of the second bank 30 flows, in turn, through the outer circumference of the liner 33 of the cylinder 4 of the second bank 30 and the inside of the cylinder cover 19 of the second bank 30 and flows into the return passage 28.

The return passage 28 is provided, for example, in the crankcase 21 and so on. The return passage 28 is connected to each of the branch passage 27 formed in the first bank 29 and the branch passage 27 formed in the second bank 30. Further, the return passage 28 communicates with the outlet port 22*o* formed in the first end portion 24. That is, the coolant flowing through the branch passage 27 formed in the first bank 29 and the coolant flowing in the branch passage 27 formed in the second bank 30 join in the return passage 28 and are guided to the outlet port 22*o*.

The coolant flowing through the above-described supply passage 26 is introduced from the inlet port 22*i* formed in the first end portion 24 and reaches the cylinder 4 close to the second end portion 25. Therefore, the temperature of the coolant flowing through the supply passage 26 is gradually increased as it approaches the second end portion 25. Therefore, the temperature of the cylinder 4 closer to the second end portion 25 tends to be higher. In other words, radiation heat to the outside becomes larger as the cylinder 4 is closer to the second end portion 25.

The external passage 23 returns the coolant discharged from the outlet port 22*o* to the coolant pump 16 via the radiator 18. The external passage 23 in the embodiment branches off downstream of the coolant pump 16 and is connected to each of two inlet ports 22*i*.

In the radiator 18, the coolant discharged from the outlet port 22*o* exchanges heat with, for example, external air, and the temperature thereof is lowered. That is, the coolant discharged from the outlet port 22*o* is cooled by the radiator 18, is then pressure-fed by the coolant pump 16 and is supplied again to the internal passage 22.

Figure 3:
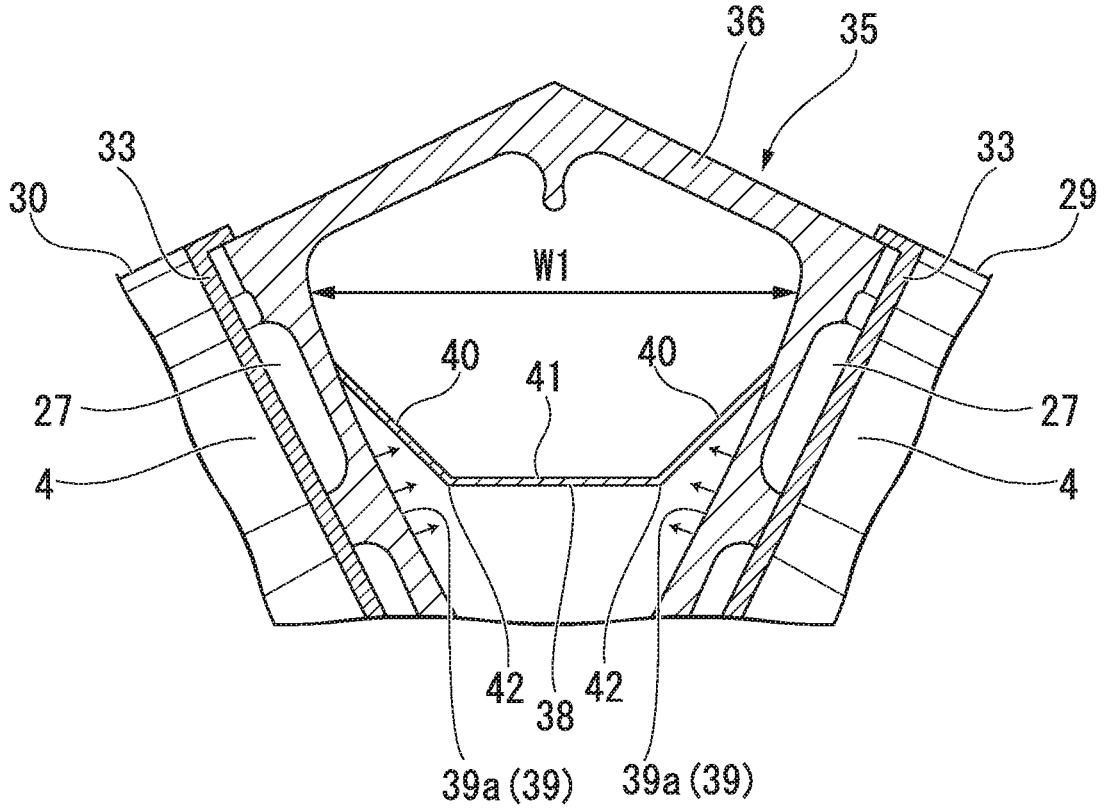
FIG. 3 is a view showing a cross section of a gas chamber orthogonal to an axial line of a crankshaft in the first embodiment of the present invention.
Figure 4:
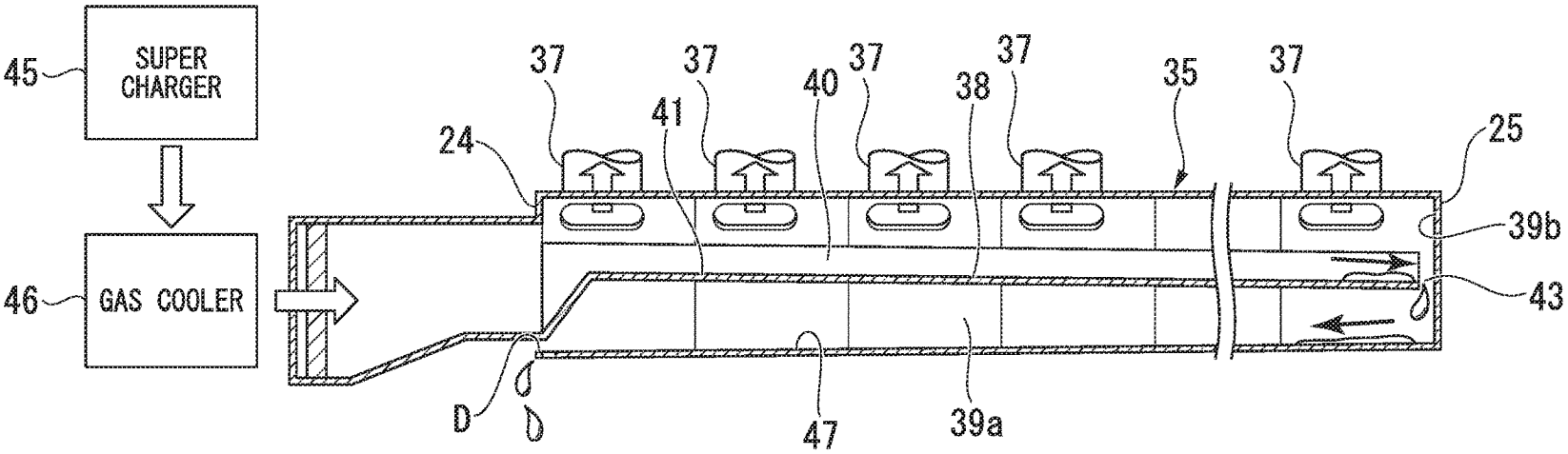
FIG. 4 is a view showing a vertical cross section of the gas chamber including the axial line of the crankshaft in the first embodiment of the present invention.

FIG. 3 is a view showing a cross section of a gas chamber orthogonal to an axial line of the crankshaft in the first embodiment of the present invention. FIG. 4 is a view showing a vertical cross section of the gas chamber including the axial line of the crankshaft in the first embodiment of the present invention.

As shown in FIGS. 1, 3 and 4, the engine 1 has a gas chamber 35 between the first bank 29 and the second bank 30. In the gas chamber 35, air or a mixed gas (gas) is introduced as supplied air from the first end portion 24. The gas chamber 35 distributes the gas to each of the cylinder 4 of the first bank 29 and the cylinder 4 of the second bank 30. The gas chamber 35 extends in the direction of the axial line O1 of the crankshaft 2. In other words, the gas chamber 35 extends along the first bank 29 and the second bank 30.

As shown in FIGS. 1 and 3, a shape of an internal space of the gas chamber 35 corresponds to a shape of a space between the first bank 29 and the second bank 30. More specifically, in the gas chamber 35, a width dimension W1 of the internal space thereof becomes smaller as it approaches the crankshaft 2 (in other words, as it goes downward). An upper wall 36 of the gas chamber 35 is formed to be inclined such that a height thereof increases toward a center in a width direction. In the upper wall 36, a plurality of openings (not shown) are formed at intervals in the direction of the axial line O1 of the crankshaft 2. The openings are closed by a lid member (not shown). Further, an air supply pipe 37 is connected to the upper wall 36 or the lid member. Gas in the gas chamber 35 is supplied to the cylinder 4 via the air supply pipe 37.

As shown in FIGS. 3 and 4, a heat shielding member 38 is provided inside the gas chamber 35. The heat shielding member 38 shields heat radiated from an inner wall surface 39 of the gas chamber 35. More specifically, the heat shielding member 38 blocks the heat radiated from the inner wall surface 39*a* of the gas chamber 35 adjacent to the cylinder 4. The heat shielding member 38 extends from the above-described first end portion 24 toward the second end portion 25. The heat shielding member 38 in the embodiment is supported by the inner wall surface 39*a*.

Further, the heat shielding member 38 in the embodiment has two inclined surfaces 40 and one flat surface (guide surface) 41. The two inclined surfaces 40 are inclined to be gradually closer to the crankshaft 2 from the inner wall surface 39 toward the center of the gas chamber 35 in the width direction. The flat surface 41 is formed to connect lower edges 42 of the inclined surfaces 40 to each other. That is, the heat shielding member 38 in the embodiment is formed to be convex downward. The heat shielding member 38 has a gap 43 between the heat shielding member 38 and the inner wall surface 39*b* of the gas chamber 35 on a side close to the second end portion 25.

By forming the heat shielding member 38 as described above, a space above the heat shielding member 38 in the gas chamber 35 may be formed to be larger while the radiation heat from the inner wall surface 39*a* of the gas chamber 35 adjacent to the cylinder 4 is shielded by the heat shielding member 38, and thus it is possible to limit a decrease in an amount of the supplied air.

As shown in FIG. 4, the engine 1 in the embodiment includes a supercharger 45 and a gas cooler 46.

The supercharger 45 compresses the gas (air or mixed gas).

The gas cooler 46 cools the gas compressed by the supercharger 45. The gas cooler 46 includes a filter (not shown) which collects condensed water generated by the gas being cooled.

The above-described heat shielding member 38 is slightly inclined to be arranged downward as it approaches the second end portion 25. Further, a bottom surface (guide surface) 47 of the above-described gas chamber 35 is slightly inclined to be disposed downward as it approaches the first end portion 24. In the vicinity of a position at which the first end portion 24 and the bottom surface 47 intersect, the gas chamber 35 has a drain D which makes the internal space and the external space of the gas chamber 35 communicate with each other. Since the inclination and the drain D are formed, the condensed water not collected by the filter moves to a side close to the second end portion 25 by its own weight due to the inclination of the heat shielding member 38 and falls from the gap 43. Subsequently, the condensed water moves along the inclination of the bottom surface 47 of the gas chamber 35 by its own weight and is then discharged from the drain D to the outside of the gas chamber 35.

According to the first embodiment, the heat shielding member 38 extends from the first end portion 24 toward the second end portion 25 inside the gas chamber 35. Therefore, the supplied gas flowing on a side opposite to the inner wall surface 39*a* of the gas chamber 35 with the heat shielding member 38 interposed therebetween may be suppressed from being heated by the radiation heat from the inner wall surface 39*a* of the gas chamber 35. Thus, it is possible to limit a temperature difference from being generated in the supplied air supplied to the cylinder 4 close to the first end portion 24 and the cylinder 4 close to the second end portion 25. Therefore, it is possible to stabilize the combustion in all of the cylinders 4 by limiting the variation of the air-fuel ratio in each of the cylinders 4.

Here, when the gas chamber 35 is provided between the banks of the V-type engine, the heat of the cylinder 4 of each of the banks is easily transmitted to the inner wall surface 39*a* of the gas chamber 35. However, in the embodiment, by providing the heat shielding member 38, it is possible to effectively suppress an influence of the radiation heat, which is caused by the heat of the cylinder 4 being transmitted to the inner wall surface 39*a* of the gas chamber 35, on the supplied air. As a result, it is possible to limit an increase in a size of the engine 1 by effectively utilizing the space between the first bank 29 and the second bank 30 and to suppress a reduction in efficiency caused by the variation in the air-fuel ratio.

Further, the heat shielding member 38 and the bottom surface 47 of the gas chamber 35 are inclined in opposite directions to each other. Therefore, even when the condensed water intrudes into the gas chamber 35, the condensed water may be guided toward the drain D by the inclination and may be discharged. Therefore, the condensed water may be smoothly discharged from the drain D of the first end portion 24.

Second Embodiment

Next, a second embodiment of the present invention will be described with reference to the drawings. Since the second embodiment is different from the above-described first embodiment only in a shape of the heat shielding member, the same reference numerals are designated to the same portions, and repeated description will be omitted.

Figure 5:
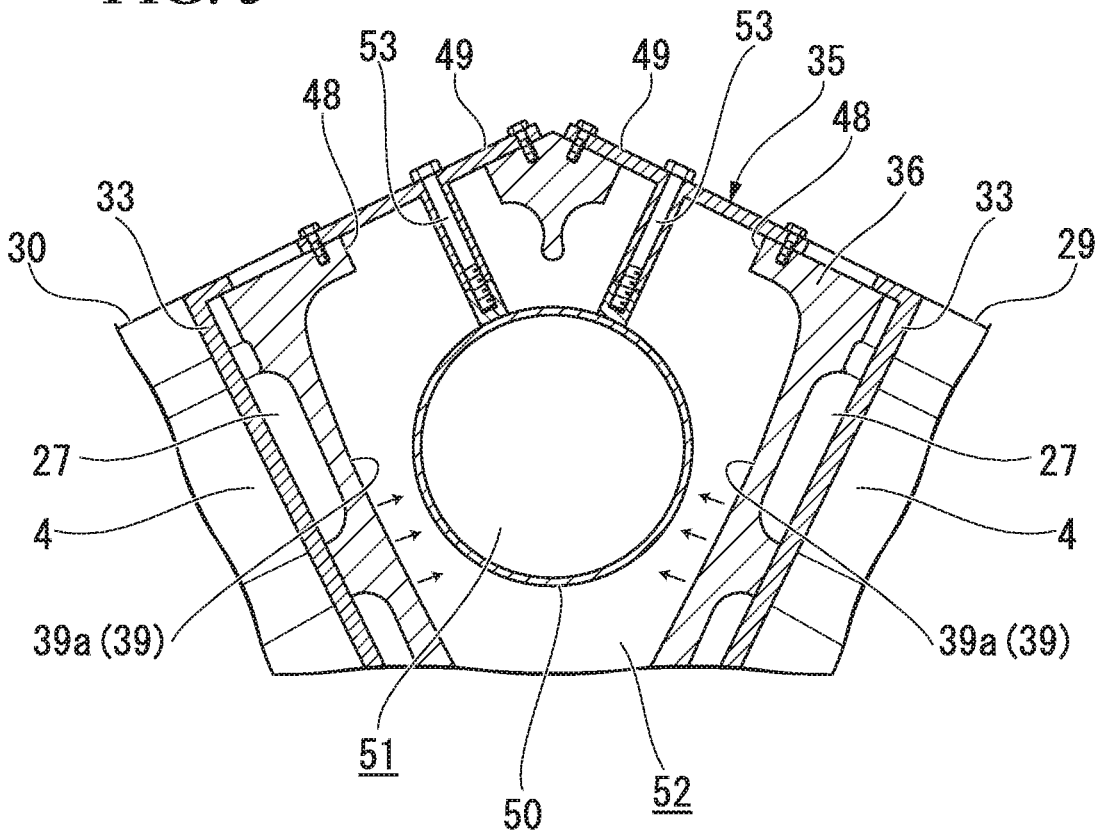
FIG. 5 is a view corresponding to FIG. 3 in a second embodiment of the present invention.
Figure 6:
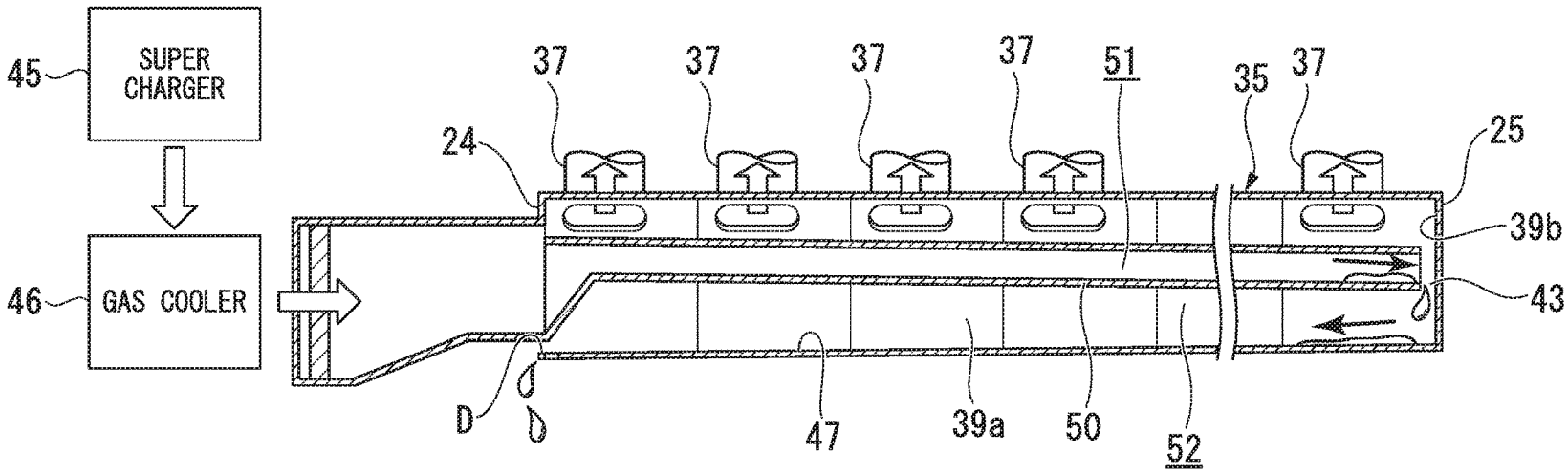
FIG. 6 is a view corresponding to FIG. 4 in the second embodiment of the present invention.

FIG. 5 is a view corresponding to FIG. 3 in the second embodiment of the present invention. FIG. 6 is a view corresponding to FIG. 4 in the second embodiment of the present invention.

As shown in FIGS. 5 and 6, the engine 1 in the embodiment has the gas chamber 35 between the first bank 29 and the second bank 30. As in the first embodiment, the gas chamber 35 extends along the first bank 29 and the second bank 30 in the direction of the axial line O1 of the crankshaft 2.

A plurality of openings 48 are formed in the upper wall 36 at intervals in the direction of the axial line O1 of the crankshaft 2. These openings 48 are closed from the outside by a plate-shaped lid member 49. Further, the air supply pipe 37 (refer to FIG. 1) is connected to the upper wall 36 or the lid member 49. The gas in the gas chamber 35 is supplied to the cylinder 4 via the air supply pipe 37.

A heat shielding member 50 is provided inside the gas chamber 35. The heat shielding member 50 in the embodiment is formed in a cylindrical shape. In other words, the heat shielding member 50 partitions an internal space of the gas chamber 35 into a first space 51 having a cylindrical shape and formed on an inner side and a second space 52 having a cylindrical shape and formed on an outer side. The heat shielding member 50 in one example of the embodiment is suspended from the lid member 49 via a fastening member 53 such as a bolt. Further, in FIG. 6, illustration of the opening 48, the lid member 49, and the fastening member 53 is omitted (the same in FIG. 8).

In the heat shielding member 50, the gas flows into the first space 51 formed on the inner side thereof from a side close to the gas cooler 1 (a side close to the first end portion 24) in the direction of the axial line O. The heat shielding member 38 has a gap 43 between the heat shielding member 38 and the inner wall surface 39*b* of the gas chamber 35 on a side close to the second end portion 25 in the direction of the axial line O1. That is, the gas flowing into the first space 51 first flows from the first end portion 24 toward the second end portion 25. Then, the gas flows into the second space 52 via the gap 43 and is distributed to each of the cylinders 4 while flowing from the second end portion 25 toward the first end portion 24.

Here, in the heat shielding member 50, the second space 52 is disposed between the heat shielding member 50 and the inner wall surface 39*a* of the gas chamber 35 adjacent to the cylinder 4. Therefore, as compared with a case in which the heat shielding member 50 is in contact with the inner wall surface 39*a*, it is possible to suppress an increase in the temperature while the gas flowing through the first space 51 inside the heat shielding member 50 flows from the first end portion 24 toward the second end portion 25.

Like the heat shielding member 38 of the first embodiment, the heat shielding member 50 is slightly inclined to be disposed downward from the first end portion 24 toward the second end portion 25.

The bottom surface 47 of the gas chamber 35 is slightly inclined to be disposed downward from the second end portion 25 toward the first end portion 24.

In the gas chamber 35, the drain D is formed in the vicinity of a position at which the first end portion 24 and the bottom surface 47 intersect.

Also in the second embodiment, as in the first embodiment, due to the inclination of the heat shielding member 50, the inclination of the bottom surface 47 of the gas chamber 35, and the drain D, the condensed water which is not collected by the filter moves by its own weight and is discharged to the outside of the gas chamber 35.

According to the above-described second embodiment, since the gas chamber 35 is partitioned into the first space 51 and the second space 52 by the heat shielding member 50, the influence of the radiation heat on the gas flowing through the first space 51 may be reduced. Therefore, it is possible to guide the gas from the first end portion 24 toward the second end portion 25 while limiting the increase in the temperature of the gas flowing through the first space 51.

Here, the gas guided toward the second end portion 25 flows into the second space 52 via the gap 43 on a side close to the second end portion 25. The gas flowing into the second space 52 flows from the second end portion 25 toward the first end portion 24 and flows into each of the cylinders 4 along the way. Since the coolant for cooling the engine 1 is supplied from the first end portion 24 toward the second end portion 25, the temperature thereof is gradually increased as the coolant approaches the second end portion 25. However, the heat shielding member 50 formed in a cylindrical shape allows the gas flowing through the second space 52 to flow from a side close to the second end portion 25, in which the temperature of the coolant is high, to a side closer to the first end portion 24, in which the temperature of the coolant is low. Therefore, it is possible to limit the temperature of the gas from being increased while the gas flows through the second space 52 from the second end portion 25 toward the first end portion 24.

As a result, it is possible to stabilize the combustion in all of the cylinders 4 by suppressing the variation of the air-fuel ratio of each of the cylinders 4. Further, since occurrence of knocking is suppressed by stabilizing the combustion, an ignition timing may be set to an advance side, and thus it is possible to increase efficiency.

The present invention is not limited to the above-described embodiments and includes various modifications to the above-described embodiments within the scope not deviating from the gist of the present invention. That is, the specific shapes, constitutions, and so on described in the embodiments are merely examples and can be appropriately changed.

First Modified Example

Figure 7:
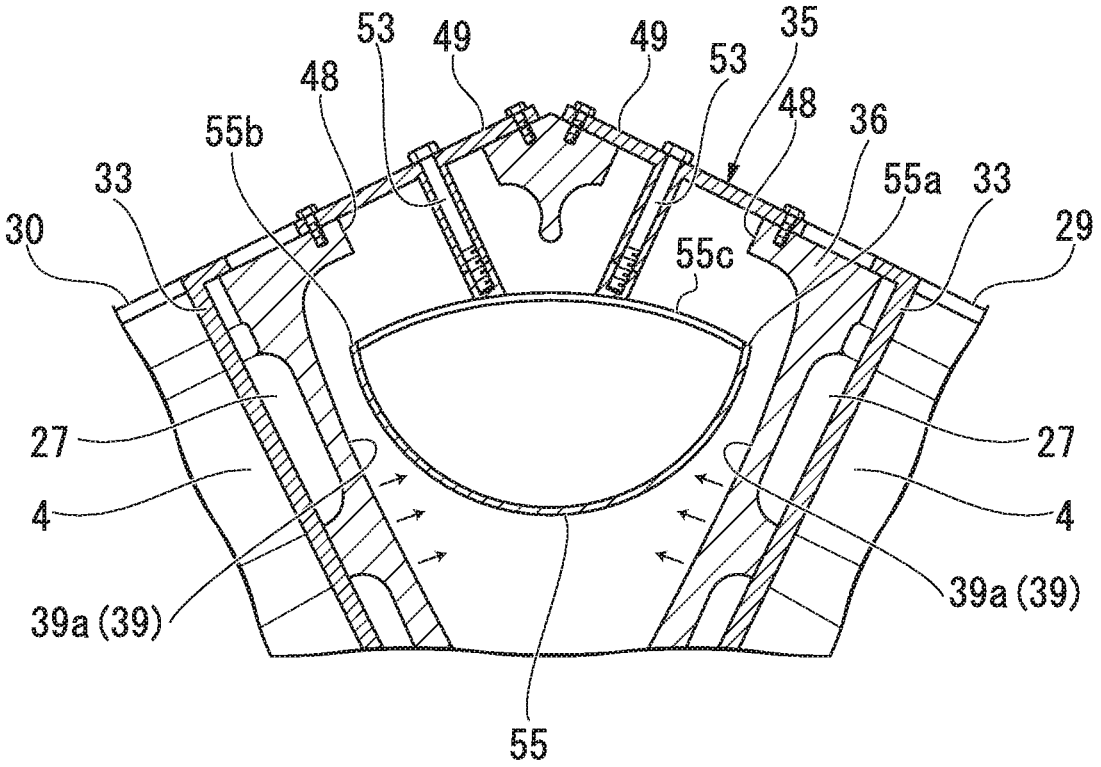
FIG. 7 is a view corresponding to FIG. 3 in a first modified example of the first embodiment of the present invention.
Figure 8:
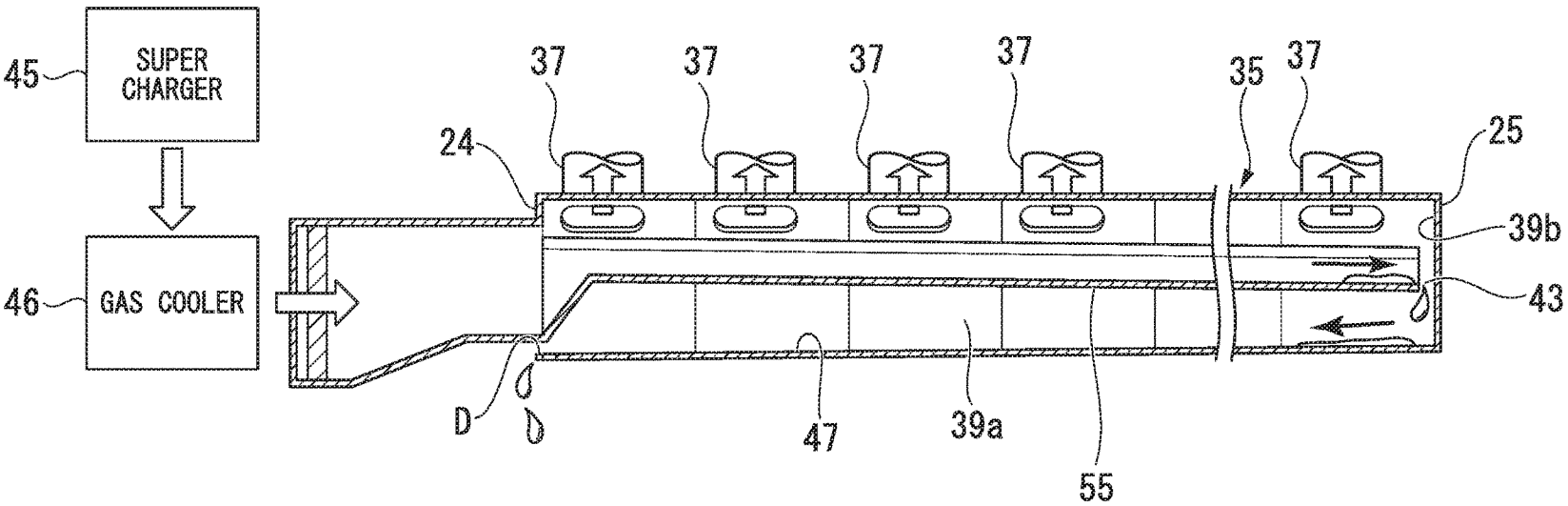
FIG. 8 is a view corresponding to FIG. 4 in the first modified example of the first embodiment of the present invention.

FIG. 7 is a view corresponding to FIG. 3 in a first modified example of the first embodiment of the present invention. FIG. 8 is a view corresponding to FIG. 4 in the first modified example of the first embodiment of the present invention.

In the above-described first embodiment, the case in which the gas chamber 35 is partitioned vertically by the heat shielding member 38 has been described. However, the present invention is not limited to the constitution of the first embodiment. For example, the internal space of the gas chamber 35 may not be vertically partitioned. More specifically, as in a first modified example shown in FIGS. 7 and 8, the heat shielding member 55 having a circular arc-shaped cross section may be suspended from the lid member 49 similarly to the heat shielding member 50 of the second embodiment. At this time, the heat shielding member 55 may be separated from the inner wall surface 39 of the gas chamber 35. In this case as well, due to the heat shielding member 55, it is possible to suppress the influence of the radiation heat from the inner wall surface 39*a* of the gas chamber 35 on the gas flowing in the direction of the axis O1 through the space opposite to the inner wall surface 39*a* of the gas chamber 35 with the heat shielding member 55 interposed therebetween. Therefore, it is possible to reduce the increase in the temperature difference of the gas supplied to each of the cylinders 4.

Here, the heat shielding member 55 is formed to have a circular-arc cross section which is convex downward in a cross section orthogonal to the axial line O1. However, the present invention is not limited to this shape, and for example, the cross section orthogonal to the axial line O1 may be a V shape or a U shape which is convex downward. In the heat shielding member 55, a crossover portion 55*c* which connects an upper edge 55*a* on a side close to the first bank 29 and an upper edge 55*b* on a side close to the second bank 30 is formed at a plurality of positions in the direction of the axial line O1, and the crossover portion 55*c* is fixed to the fastening member 53.

Second Modified Example

Figure 9:
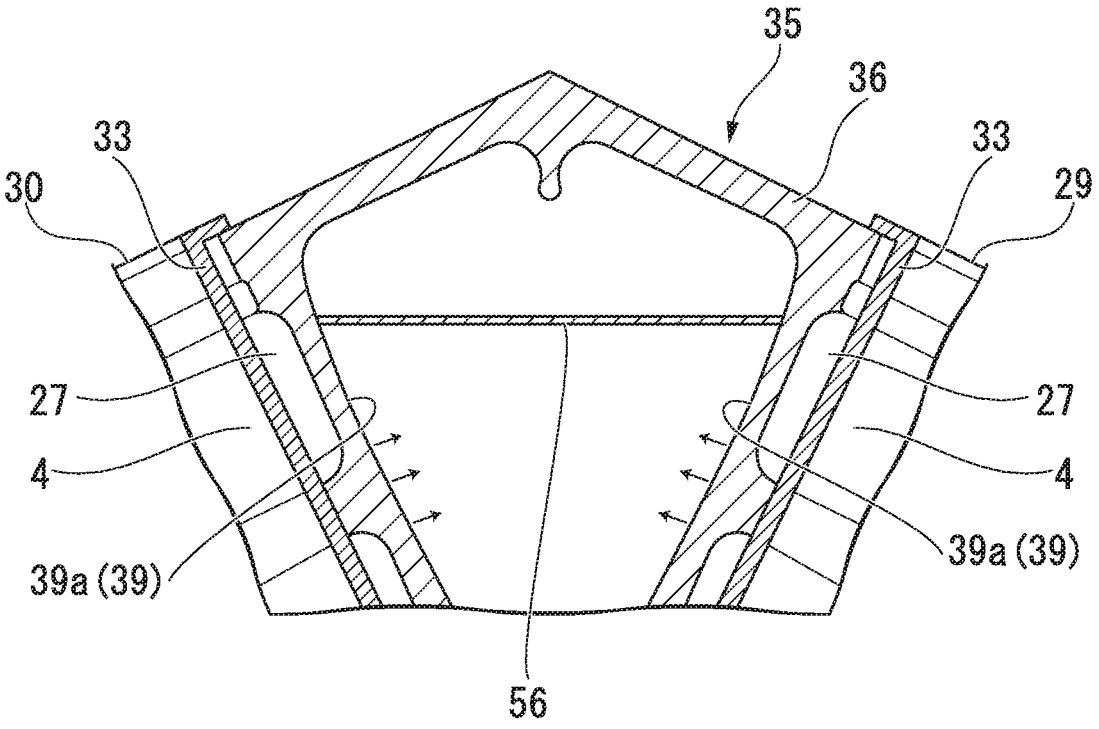
FIG. 9 is a view corresponding to FIG. 3 in a second modified example of the first embodiment of the present invention.
Figure 10:
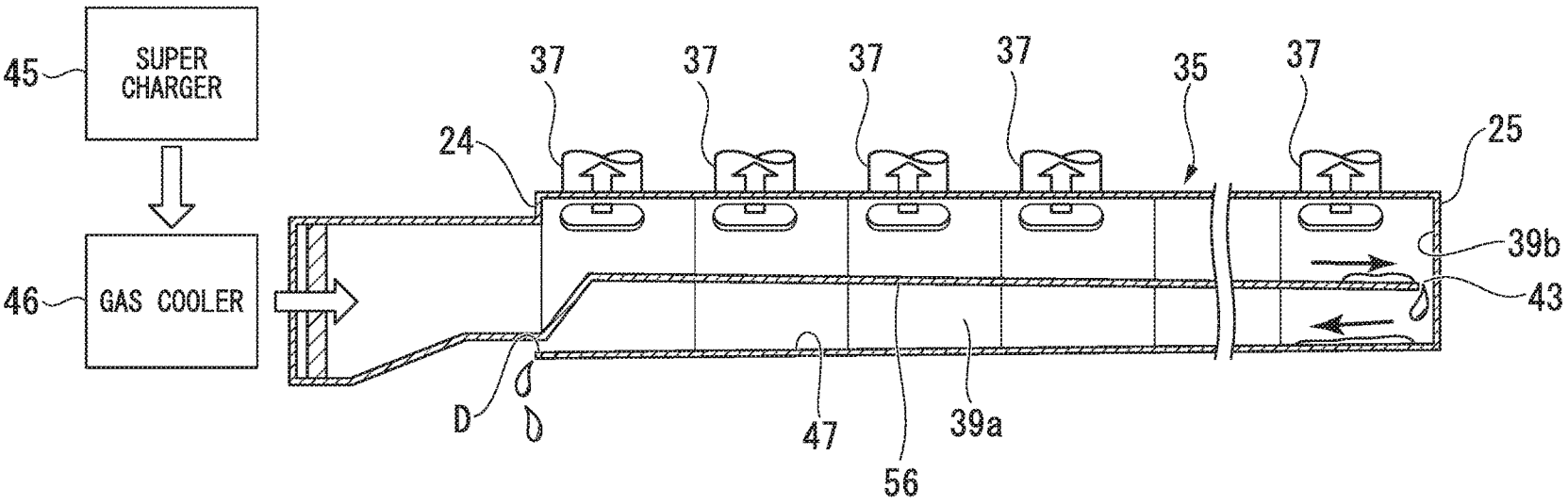
FIG. 10 is a view corresponding to FIG. 4 in the second modified example of the first embodiment of the present invention.

FIG. 9 is a view corresponding to FIG. 3 in a second modified example of the first embodiment of the present invention. FIG. 10 is a view corresponding to FIG. 4 in the second modified example of the first embodiment of the present invention.

In the above-described first embodiment, the case in which the heat shielding member 38 is formed to be convex downward has been described. However, the present invention is not limited to this shape. For example, as in a heat shielding member 56 of the second modified example shown in FIGS. 9 and 10, a cross section orthogonal to the axial line O1 may be formed in a flat plate shape which extends horizontally. In this case, as the heat shielding member 56 is disposed at a position close to the upper wall 36 of the gas chamber 35, the influence of the radiation heat from the inner wall surface 39*a* of the gas chamber 35 adjacent to the cylinder 4 may be reduced.

Other Modified Examples

In the above-described first embodiment, the case in which the cross section of the heat shielding member 38 orthogonal to the axial line O1 is formed in a trapezoidal shape which is convex downward has been described. However, the present invention is not limited to this shape. For example, the cross section orthogonal to the axial line O1 may be an arc shape, a V shape, a U shape, or the like.

Further, in the above-described embodiment, the case in which the gas chamber 35 is formed between the first bank 29 and the second bank 30 has been described. However, the gas chamber 35 needs only to extend from the first end portion 24 toward the second end portion 25 and may also be disposed at a position other than between the first bank 29 and the second bank 30.

Also, in the above-described embodiment, the case in which the engine 1 is the V-type engine has been described, but for example, an in-line engine in which the width dimension W1 of the gas chamber 35 does not change in a height direction may be used. Further, in the above-described embodiment, the case in which the engine 1 is the gas engine having the auxiliary chamber has been described, but a gas engine which has no auxiliary chamber may be used. Furthermore, the engine 1 is not limited to the stationary engine forming a power generation system and may be, for example, a marine engine or the like. In addition, although the engine 1 is an exemplary example of the gas engine, the gas engine may be an engine driven by a fuel other than gas.

Further, in the above-described second embodiment, the case in which the gas flowing through the first space 51 inside the cylindrical heat shielding member 50 flows into the second space 52 via the gap 43 between the end portion of the heat shielding member 50 and the inner wall surface 39*b* of the gas chamber 35 on the side close to the second end portion 25 has been described. However, the present invention is not limited to such a constitution. For example, a communication port which communicates the first space 51 and the second space 52 with each other may be formed facing downward in the direction of the axial line O1 at a center of the heat shielding member 50 or at a position close to the first end portion 24. With such a constitution, for example, the condensed water may fall through the communication port while the influence of the radiation heat on the gas flowing through the first space 51 is reduced. Therefore, intrusion of the condensed water into the cylinder 4 may be suppressed. In the case in which the communication port is formed, the gap 43 may be omitted.

Further, in the above-described embodiment, the case in which the second space 52 is disposed between the heat shielding member 50 and the inner wall surface 39*a* has been described. However, the heat shielding member 50 and a part of the inner wall surface 39*a* may be brought into contact with each other to form a portion in which the second space 52 is not disposed between the heat shielding member 50 and the inner wall surface 39*a*.

Further, in the above-described second embodiment and the first modified example of the first embodiment, the case in which the heat shielding members 50 and 55 are suspended from the upper side by the fastening member 53 has been described, but a support structure of the heat shielding members 50 and 55 is not limited to the above-described support structure. Further, in the above-described first embodiment and the second modified example of the first embodiment, the case in which the heat shielding members 38 and 56 are supported by the inner wall surface 39*a* has been described. However, a support structure of the heat shielding members 38 and 56 is not limited to the above-described support structure. For example, the heat shielding members 38 and 56 may be disposed apart from the inner wall surface 39*a*.

Furthermore, in each of the above-described embodiments, the case in which the engine 1 includes the supercharger 45 and the gas cooler 46 has been described as an example. However, the present invention may also be applied to an engine which does not include the supercharger 45 or the gas cooler 46.

INDUSTRIAL APPLICABILITY

The present invention can be applied to engines. According to this engine, the combustion can be stabilized in all of the cylinders, and thus the efficiency can be improved.

REFERENCE SIGNS LIST

1 Engine
2 Crankshaft
3 Piston
4 Cylinder
5 Cam shaft
6 Push rod
7 Base end portion
8 Distal end portion
9 Rocker arm
10 Base portion
11 End portion
12 Intake valve
13 Exhaust valve
14 Port
15 Cooling device
16 Coolant pump
17 Coolant passage
18 Radiator
19 Cylinder cover
20 Cylinder block
21 Crankcase
22 Internal passage
23 External passage
24 First end portion
25 Second end portion
26 Supply passage
27 Branch passage
28 Return passage
29 First bank
30 Second bank
31 Inner wall
32 Outer wall
33 Liner
35 Gas chamber
36 Upper wall
37 Air supply pipe
38 Heat shielding member
39 Inner wall surface
40 Inclined surface
41 Flat surface
42 Lower edge of inclined surface
43 Gap
45 Supercharger
46 Gas cooler
47 Bottom surface (guide surface)
48 Opening
49 Lid member
50 Heat shielding member
51 First space
52 Second space
53 Fastening member
55 Heat shielding member
56 Heat shielding member

What is claimed is:

1. An engine comprising:

a plurality of cylinders provided along a crankshaft;

a gas chamber configured to extend from a first end portion toward a second end portion in a direction of an axial line of the crankshaft and to distribute gas into the plurality of cylinders; and a heat shielding member provided in the gas chamber and configured to extend from the first end portion toward the second end portion and to shield heat radiated from an inner wall surface of the gas chamber wherein a plurality of air supply pipes that supply the gas in the gas chamber to the plurality of cylinders, respectively, are connected to an upper wall of the gas chamber or a plurality of lid members that respectively closes a plurality of openings formed in the upper wall, and the engine further comprises a cooling device configured to cause coolant cooling the cylinders to flow from the first end portion toward the second end portion in the direction of the axial line, wherein the heat shielding member partitions an internal space of the gas chamber into a first space configured to guide the gas introduced into the gas chamber from the first end portion toward the second end portion, and a second space configured to communicate with the first space and to distribute the gas flowing in from the first space into the plurality of cylinders while guiding the gas from the second end portion toward the first end portion.

2. The engine according to claim 1, wherein the heat shielding member extends in the direction of the axial line so that the second space is disposed between an inner wall surface of the gas chamber adjacent to the cylinder and the first space.

3. The engine according to claim 1, wherein the heat shielding member is formed in a cylindrical shape extending in the direction of the axial line.

4. The engine according to claim 1, wherein the plurality of cylinders are arranged in a V shape, and the gas chamber is arranged between banks of the cylinders arranged in the V shape.

5. An engine comprising:

a plurality of cylinders provided along a crankshaft;

a gas chamber configured to extend from a first end portion toward a second end portion in a direction of an axial line of the crankshaft and to distribute gas into the plurality of cylinders; and a heat shielding member provided in the gas chamber and configured to extend from the first end portion toward the second end portion and to shield heat radiated from an inner wall surface of the gas chamber wherein a plurality of air supply pipes that supply the gas in the gas chamber to the plurality of cylinders, respectively, are connected to an upper wall of the gas chamber or a plurality of lid members that respectively closes a plurality of openings formed in the upper wall, and the engine further comprises a supercharger configured to compress the gas introduced from the outside, a gas cooler configured to cool the gas compressed by the supercharger before being introduced into the gas chamber, and a guide surface provided in the gas chamber and configured to guide condensed water contained in the gas introduced into the gas chamber.

* * * * *